US006402454B1

(12) United States Patent
Yamaguchi et al.

(10) Patent No.: US 6,402,454 B1
(45) Date of Patent: Jun. 11, 2002

(54) FORKLIFT

(75) Inventors: Yasuyuki Yamaguchi; Sanpei Kikuchi, both of Shiga; Haruhiko Kakitsubata, Kyoto; Takahiro Kitao, Kyoto; Hiroshi Minami, Kyoto; Shinobu Tanaka, Shiga-gun, all of (JP)

(73) Assignee: Nippon Yusoki Co., Ltd., Kyoto (JP)

( * ) Notice: Subject to any disclaimer, the term of this patent is extended or adjusted under 35 U.S.C. 154(b) by 0 days.

(21) Appl. No.: 09/413,500

(22) Filed: Oct. 6, 1999

(30) Foreign Application Priority Data

Oct. 14, 1998 (JP) ..... 10-291662
Oct. 14, 1998 (JP) ..... 10-291664
Oct. 14, 1998 (JP) ..... 10-291669

(51) Int. Cl.[7] ..... B66F 9/22
(52) U.S. Cl. ..... 414/661
(58) Field of Search ..... 414/661

(56) References Cited

U.S. PATENT DOCUMENTS 4,164,121 A * 8/1979 Houseman et al. ..... 60/486
4,284,384 A 8/1981 Olson ..... 414/434
4,297,070 A * 10/1981 Didtel ..... 414/661 X
6,164,415 A * 12/2000 Takeuchi et al. ..... 187/224

FOREIGN PATENT DOCUMENTS

GB 2 200 889 8/1988 ..... B66F/9/06
JP 1281299 * 11/1989 ..... 414/661
JP 2221783 * 9/1990
JP 9-202597 8/1997 ..... B66F/9/19

* cited by examiner

*Primary Examiner*—Steven A. Bratlie
(74) *Attorney, Agent, or Firm*—Sughrue Mion, PLLC

(57) ABSTRACT

A forklift, in which, if a synchronous mode change-over switch is depressed, a forward/backward moving lever is switched over to the backward moving side, and a throttle pedal is stepped down, then a pusher is moved forward by a pusher cylinder in synchronization with the backward movement of the vehicle body of the forklift to thereby push out baggage carried on a fork therefrom. An oil pressure circuit connects together a pusher cylinder and an oil pressure pump. A hand-operated switch valve 21 is disposed in the oil pressure circuit. A valve full-open switch 22 opposes a projection portion 25 provided on and projected from a pusher lever 12 which is used to switch the state of the hand-operated switch valve 21. When the pusher lever 12 fully opens the hand-operated switch valve 21, the projection portion 25 contacts with the valve full-open switch 22 to thereby allow the valve full-open switch 22 to issue a detect signal to a control part of the forklift. Upon receiving the detect signal sent form the valve full-open switch 22, the control part operates a synchronous mode.

2 Claims, 12 Drawing Sheets

FORKLIFT

BACKGROUND OF THE INVENTION

1. Field of the Invention

The present invention relates to a forklift structured such that baggage carried on a fork can be pushed out by a pusher movable forward in synchronization with the backward movement of a vehicle body.

2. Description of the Related Art

Conventionally, as a forklift of this type, there is known a forklift as shown in FIG. 6. The forklift comprises an electric vehicle body 1 which includes a mast 2 in the front portion thereof and an elevator body 3 so disposed on the mast 2 as to be movable upward and downward; and, there is provided a fork 4 on the elevator body 3 in such a manner as to project forwardly from the elevator body 3. And, a pusher 6 is mounted on the elevator body 3 through a pantograph-like link mechanism 5 and, between the elevator body 3 and link mechanism 5, there is interposed a pusher cylinder 7 which expands and compresses the link mechanism 5 to thereby move the pusher 6 forward, that is, in the direction of an arrow line "a" as shown in FIG. 6 (forward movement "a") and backward, that is, in the direction of an arrow "b" shown in FIG. 6 (backward movement "b") along the upper surface of the fork 4. Also, on the elevator body 3, there is disposed a pusher moving amount detector 9 composed of a potentiometer or the like which can detect the moving amount of the pusher 6 from the pull-out length of a cable body 8 connected to the pusher 6. Further, a vehicle speed detector 1*c* is disposed on a vehicle drive motor 1*b* which is mounted within the vehicle body 1. Also, as shown in FIG. 7, in the controls 1*a* of the vehicle body 1, there are disposed a steering wheel 10, a throttle pedal 11, a pusher lever 12, a synchronous mode change-over switch 13, a synchronous mode lamp 13*a,* and a forward/backward moving lever 14.

Conventionally, as shown in FIG. 8, in an oil pressure circuit 16 which connects together the pusher cylinder 7 and an oil pressure pump 15, there is disposed a proportional electromagnetic control valve 17 having four ports and three positions. Reference character 18 designates a drive motor for driving the oil pressure pump 15, while 19 stands for an oil pressure tank.

In the above-mentioned structure, as shown by a solid line in FIG. 6, while baggage W is carried on the fork 4, if the synchronous mode change-over switch 13 is depressed, the forward/backward moving lever 14 is switched from the neutral position thereof to the backward moving side thereof, and the throttle pedal 11 held at the neutral position thereof is stepped down, then a synchronous mode is operated; and, at the same time when the vehicle body drive motor 1*b* is driven and the vehicle body 1 is thereby moved backward "b", the pressure oil supply amount is adjusted by the proportional electromagnetic control valve 17 which has been switched over to a right side expansion position A according to the amount of step-down of the throttle pedal 11 to thereby control the expansion speed of a piston rod 7*a,* whereby the pusher 6 is moved forward a in synchronization with the backward movement b of the vehicle body 1 to thereby push out the baggage W on the fork 4 (see an imaginary line shown in FIG. 6).

Thereafter, the synchronous mode can be removed by depressing the synchronous mode change-over switch 13.

However, in the above-mentioned conventional forklift, in order to move forward the pusher 6 in the arrow line a direction in synchronization with the backward movement "b" of the vehicle body 1, there is used an expensive proportional electromagnetic control valve 17, which leads to the expensive manufacturing cost of the forklift.

In view of the above, there can be expected a structure in which, instead of the expensive proportional electromagnetic control valve 17, there is used an inexpensive hand-operated switch valve and the hand-operated switch valve is operated by hand using the pusher lever 12. However, in this structure, if an operator operates the hand-operated switch valve in a smaller amount than a set operation amount to thereby control or reduce the pressure oil supply amount to the pusher cylinder 7 too much, then the synchronous operation may be performed incorrectly, thereby causing the properly arranged pieces of baggage to collapse or become rearrangred in a state of disorder.

Further, in the above-mentioned conventional forklift, since the synchronous mode change-over switch 13 is distant from the steering wheel 10 and pusher lever 12, each time the synchronous mode is switched, an operator must release his or her hand from the steering wheel 10 or pusher lever 12 and press down the synchronous mode change-over switch 13, which results in a poor operation efficiency. Also, to remove the synchronous mode after completion of the operation in the synchronous mode, it is necessary to press down the synchronous mode change-over switch 13, which takes time and labor.

Furthermore, in the above-mentioned conventional forklift, the moving amount of the pusher 6 is detected by the pusher moving amount detector 9, the speed of the vehicle body 1 is detected by the vehicle speed detector 1*c* from the number of rotations of the axle shaft or motor shaft, and, in accordance with the detect signals respectively issued from the two detectors 9 and 1*c,* the backward movement "b" of the vehicle body 1 and the forward movement "a" of the pusher 6 are allowed to synchronize with each other. However, when the tire 1*d* is worn due to use for a long period of time, there is produced an error between the actual vehicle speed and the detected vehicle speed.

Also, in the conventional structure, because no means is disposed for correcting the above-mentioned error, the forward movement "a" of the pusher 6 can be faster than the backward movement "b" of the vehicle body 1, which not only makes it impossible to place the pieces of baggage W at their respective given positions but also may lead to the pieces of baggage W collapsing or becoming rearranged in a state of disorder.

SUMMARY OF THE INVENTION

The object of the present invention is to eliminate the drawbacks found in the above-mentioned conventional forklift and to provide a forklift which can be manufactured at a low cost and is able to carry out a synchronous operation positively to thereby unload the baggage safely therefrom.

It is another object of the invention to provide a forklift which not only allows an operator to press down a synchronous mode change-over switch without releasing his or her hand from a pusher lever, but also allows the synchronous mode to be removed automatically after completion of the operation in the synchronous mode.

It is also an object of the invention to provide a forklift which allows the backward movement of the vehicle body of the forklift and the forward movement of the pusher to synchronize with each other with no error between them.

In attaining the above object, according to a first aspect of the invention, there is provided a forklift structured such that, while baggage is carried on a fork, if a synchronous mode change-over switch is depressed, a forward/backward moving lever is switched over to its backward moving side, and a throttle pedal is stepped down, then a pusher is moved forward by a pusher cylinder in synchronization with the backward movement of the vehicle body of the forklift to thereby push out the baggage on the fork, wherein, in an oil pressure circuit for connecting together the pusher cylinder and an oil pressure pump, there is disposed a hand-operated switch valve, and there is disposed a valve full-open switch for detecting that the hand-operated switch valve is fully opened, and also wherein, on receiving a detect signal form the valve full-open switch, a synchronous mode is operated.

According to the above structure, there is disposed the inexpensive hand-operated change-over valve in the oil pressure circuit connecting together the oil pressure pump and the pusher cylinder which is used to move the pusher forward in synchronization with the backward movement of the vehicle body, which makes it possible to reduce the manufacturing cost of the forklift. Also, since the synchronous mode is operated on receiving the detect signal sent from the valve full-open switch which can detect that the hand-operated switch valve is opened fully, there is prevented the possibility that, as in the conventional forklift, the pressure oil supply amount to the pusher cylinder can be excessively reduced to thereby cause a poor synchronous operation. Thanks to this, the synchronous operation can be carried out positively and thus the baggage on the fork can be unloaded safely.

According to a second aspect of the invention, the valve fall-open switch comprises a micro switch which is so disposed as to be opposed to the projection portion provided on and projected from the pusher lever for switching the state of the hand-operated switch valve. In operation, if the pusher lever is moved toward its forward moving side to thereby open the hand-operated switch valve fully, then the projection portion is contacted with the micro switch to thereby allow the micro switch to output a detect signal.

According to the present structure, it is possible to confirm that the hand-operated switch valve is opened fully using a simple structure which is composed of the projection portion provided on and projected from the pusher lever and the micro switch so disposed as to be opposed to the present projection portion, which allows the forklift to be manufactured at a low cost.

According to a third aspect of the invention, there is provided a forklift structured such that, while baggage is carried on a fork, if a synchronous mode change-over switch is depressed, a forward/backward moving lever is switched over to its backward moving side, and a throttle pedal is stepped down, then a pusher is moved forward by a pusher cylinder in synchronization with the backward movement of the vehicle body of the forklift to thereby push out the baggage on the fork, wherein the synchronous mode change-over switch is mounted on a pusher lever used to operate the pusher cylinder.

According to the above structure, since the synchonous mode change-over switch is mounted on the pusher lever, an operator is able to press down the synchronous mode change-over switch to thereby switch the synchronous mode without releasing his or her hand from the pusher lever.

Also, according to a fourth aspect of the invention, there is provided a forklift structured such that, while baggage is carried on a fork, if a synchronous mode change-over switch is depressed, a forward/backward moving lever is switched over to its backward moving side, and a throttle pedal is stepped down, then a synchronous mode is operated by a control part comprising a microcomputer and a pusher is moved forward by a pusher cylinder in synchronization with the backward movement of the vehicle body of the forklift to thereby push out the baggage on the fork, wherein the control part is structured such that it is able to remove the synchronous mode in accordance with not only the detect signal notifying that the pusher lever for operating the pusher cylinder and throttle pedal have been returned to their respective neutral positions but also the detect signal notifying that the pusher has moved most forward.

According to the above structure, after completion of the operation in the synchronous mode, the synchronous mode can be automatically removed by the control part in accordance with not only the detect signal notifying that the pusher lever and throttle pedal have been returned to their respective neutral positions but also the detect signal notifying that the pusher has moved most forward. This eliminates the need that, as in the conventional forklift, the synchronous mode is removed by pressing down the synchronous mode change-over switch. Therefore, the present invention does not take time and labor but can provide a high operation efficiency.

According to a fifth aspect of the invention, there is provided a forklift structured such that, while baggage is carried on a fork, if a synchronous mode change-over switch is depressed, a forward/backward moving lever is switched over to its backward moving side, and a throttle pedal is stepped down, then a pusher is moved forward by a pusher cylinder in synchronization with the backward movement of the vehicle body of the forklift to thereby push out the baggage on the fork therefrom, wherein there is disposed an output adjusting device which is used to adjust the output of an oil pressure pumpdrive motor for driving an oil pressure pump for the pusher cylinder or the output of a vehicle body drive motor.

According to the above structure, when there is produced an error between the actual vehicle speed and the detected vehicle speed, for example, because the tire of the forklift vehicle body is worn due to use for a long period of time, the thus produced error can be corrected by adjusting the output of the oil pressure pump drive motor or vehicle body drive motor due to the operation of the output adjusting device, thereby allowing the backward movement of the vehicle body and the forward movement of the pusher to synchronize with each other with no error between them. Thanks to this, the pieces of baggage respectively pushed out from the fork by the pusher can be placed positively at their given positions without turning them into a state of disorder.

Also, according to a sixth aspect of the invention, in the invention of the fifth aspect of the invention, the output adjusting device comprises a variable resistor and, in accordance with an output signal issued from the present variable resistor, the output of the oil pressure pump drive motor or vehicle body drive motor is controlled by the control part comprising a microcomputer.

According to the above structure, because an inexpensive variable resistor is used, the manufacturing cost of the forklift can be reduced when compared with the conventional forklift. Also, in accordance with the output signal of the present variable resistor, the output of the oil pressure pump drive motor or vehicle body drive motor can be controlled accurately by the control part which comprises a microcomputer.

DETAILED DESCRIPTION OF THE PRESENT INVENTION

Figure 1:
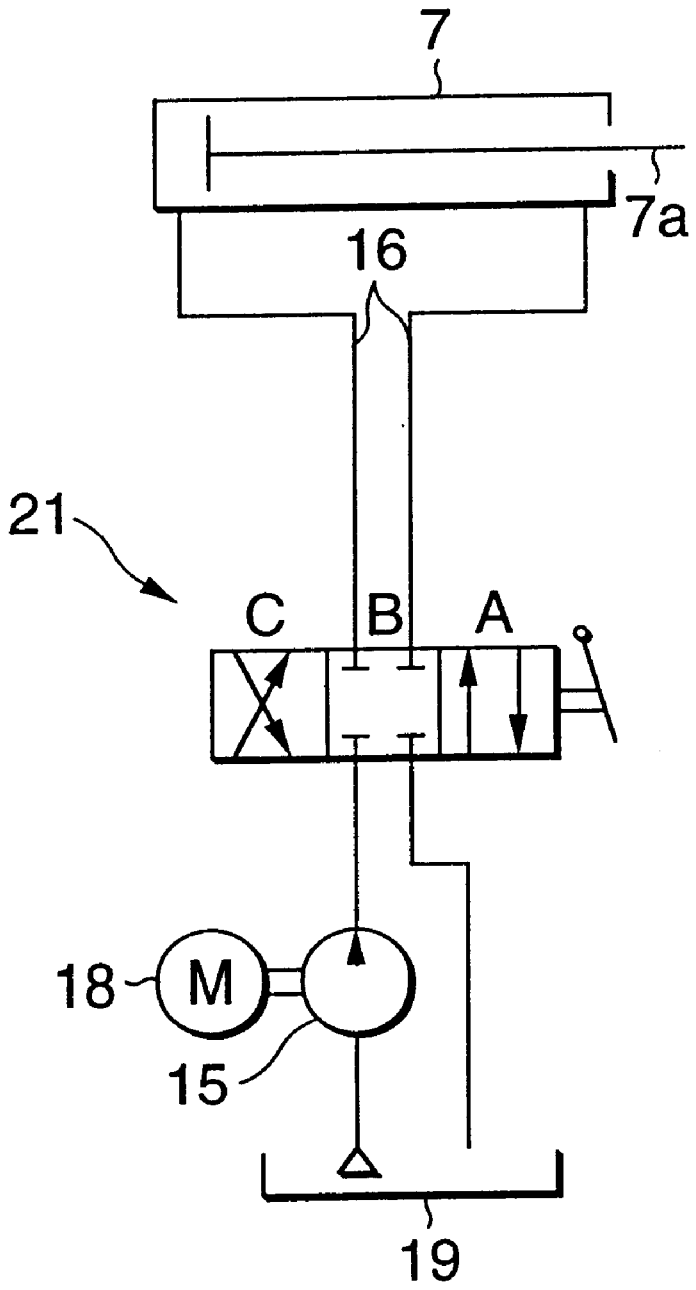
FIG. 1 is a circuit diagram of an oil pressure circuit employed in a forklift according to an embodiment of the present invention.

Now, description will be given below of a preferred embodiment of a forklift according to the invention with reference to the accompanying drawings. At first, FIGS. 1 to 3 respectively show the main portions of a forklift according to a preferred embodiment of the invention. In the embodiment, in an oil pressure circuit 16 which connects together a pusher cylinder 7 and an oil pressure pump 15, there is disposed a hand-operated switch valve 21, while a valve full-open switch 22 is disposed in such a manner that it is opposed to a pusher lever 12 used to operate the hand-operated switch valve 21 by hand. The remaining portions of the present embodiment than the above-mentioned portions are almost the same in structure as those of the previously described conventional forklift shown in FIGS. 6 and 7. Therefore, in the present embodiment, the same parts are given the same designations and thus the description thereof is omitted here.

Figure 2:
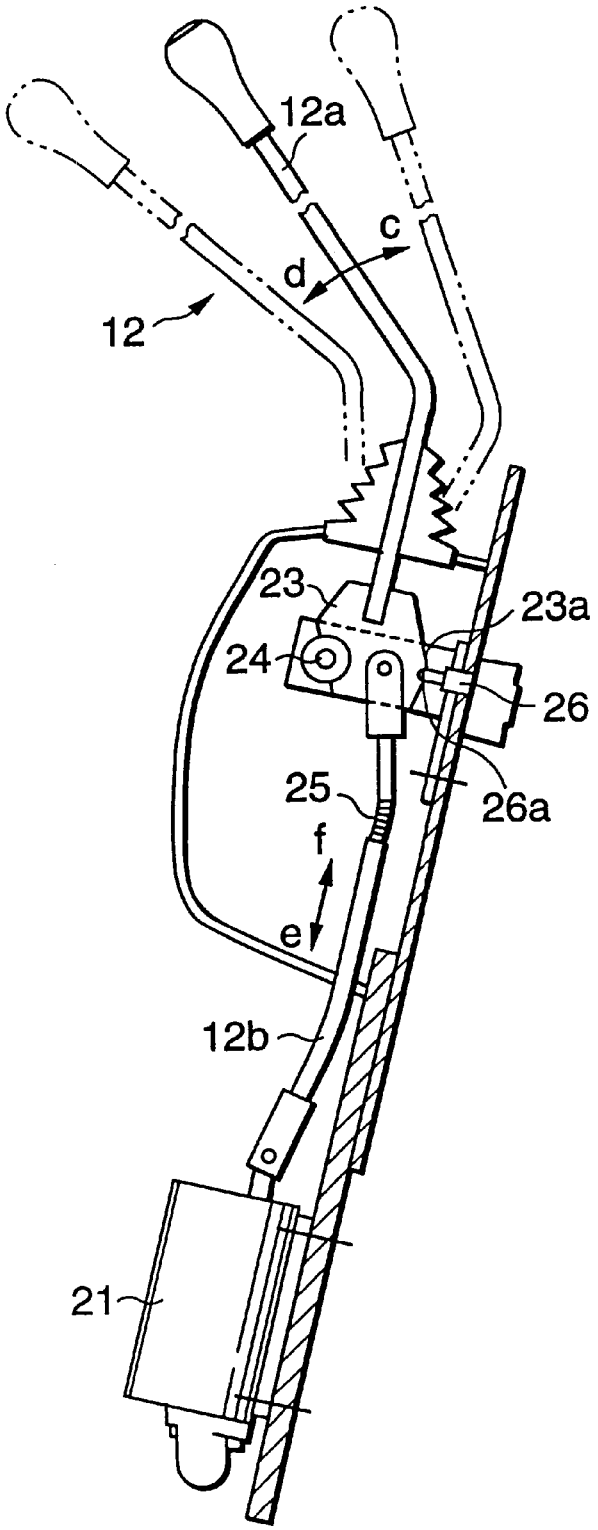
FIG. 2 is a side view of a pusher lever and its neighboring portion employed in the embodiment of the present invention.
Figure 3:
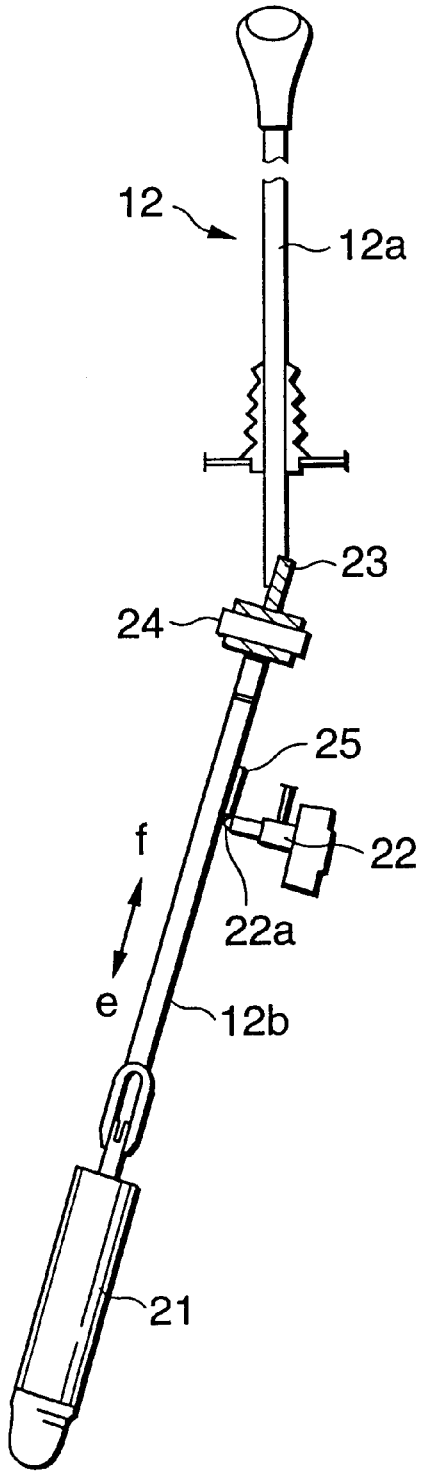
FIG. 3 is a front view of the pusher lever and its neighboring portion employed in the embodiment.

The pusher lever 12, as shown in FIGS. 2 and 3, comprises a lever main body 12*a* rotatably supported on a support shaft 24 provided on a vehicle body 1 with a connecting plate 23 fixedly secured to the base end portion of the pusher lever 12, and a connecting rod 12*b* having one end connected to the connecting plate 23 by a pin with the other end connected to the spool of the hand-operated switch valve 21 by a pin.

Figure 6:
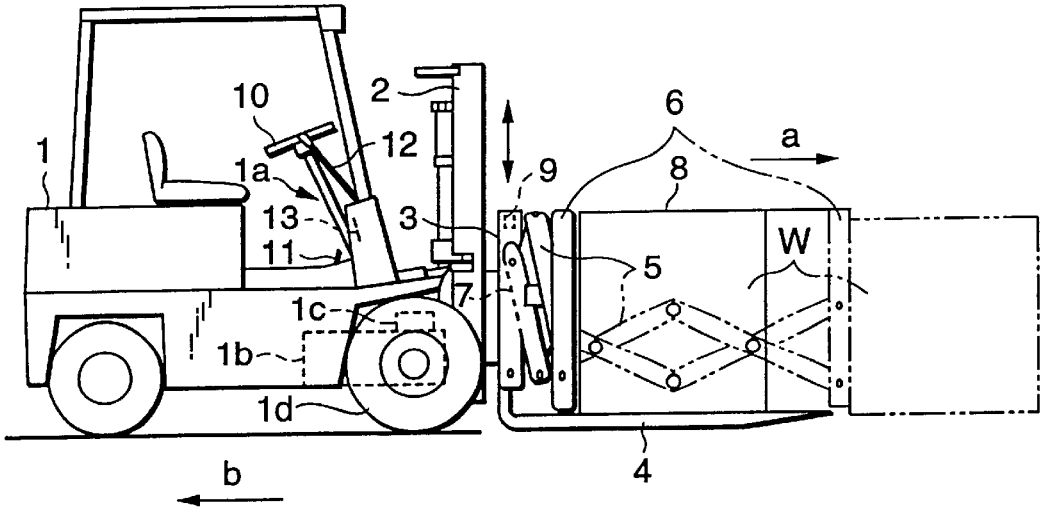
FIG.6 PRIOR ART
FIG. 6 is a side view of the whole structure of a forklift.
Figure 7:
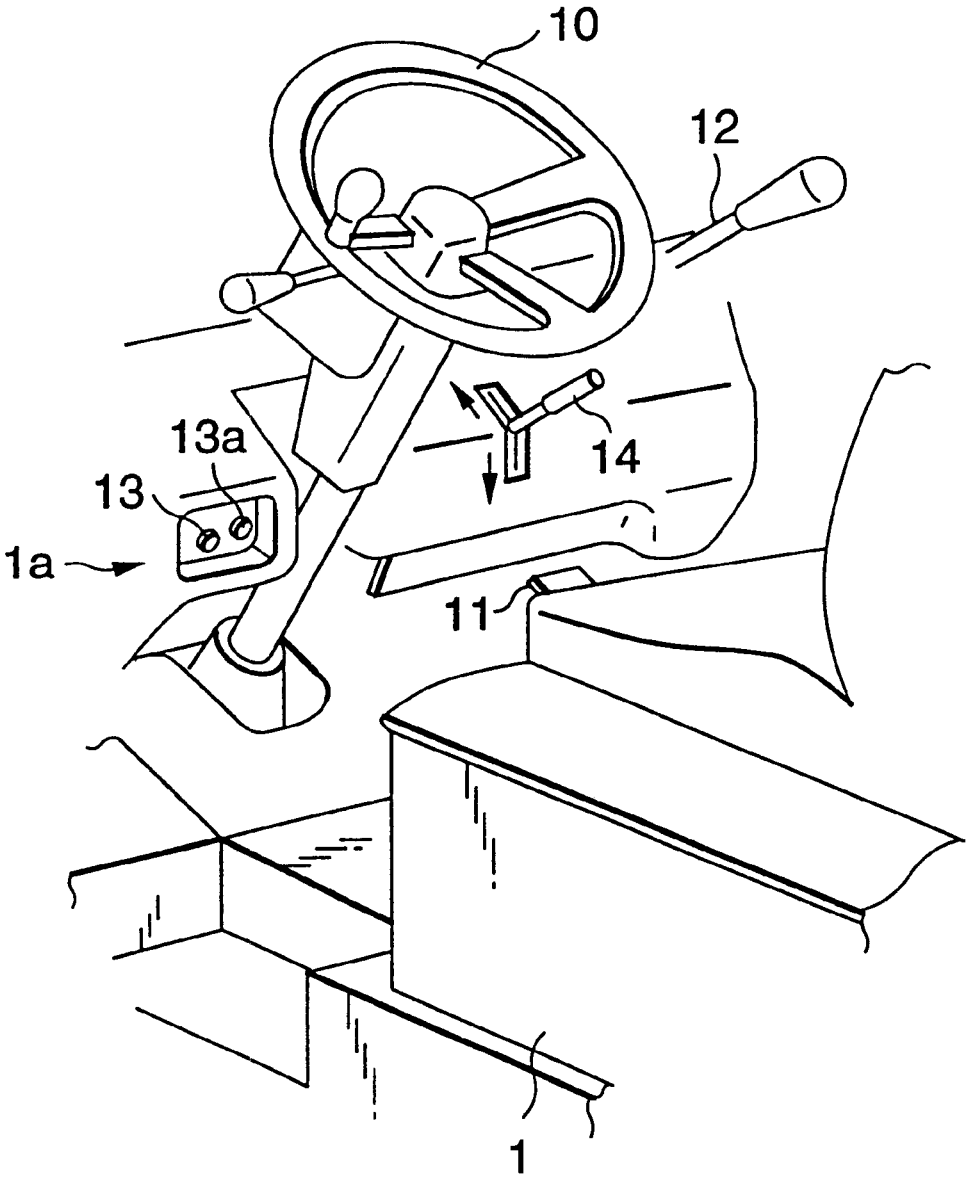
FIG.7 PRIOR ART
FIG. 7 is a perspective view of an operation part employed in the above forklift.
Figure 8:
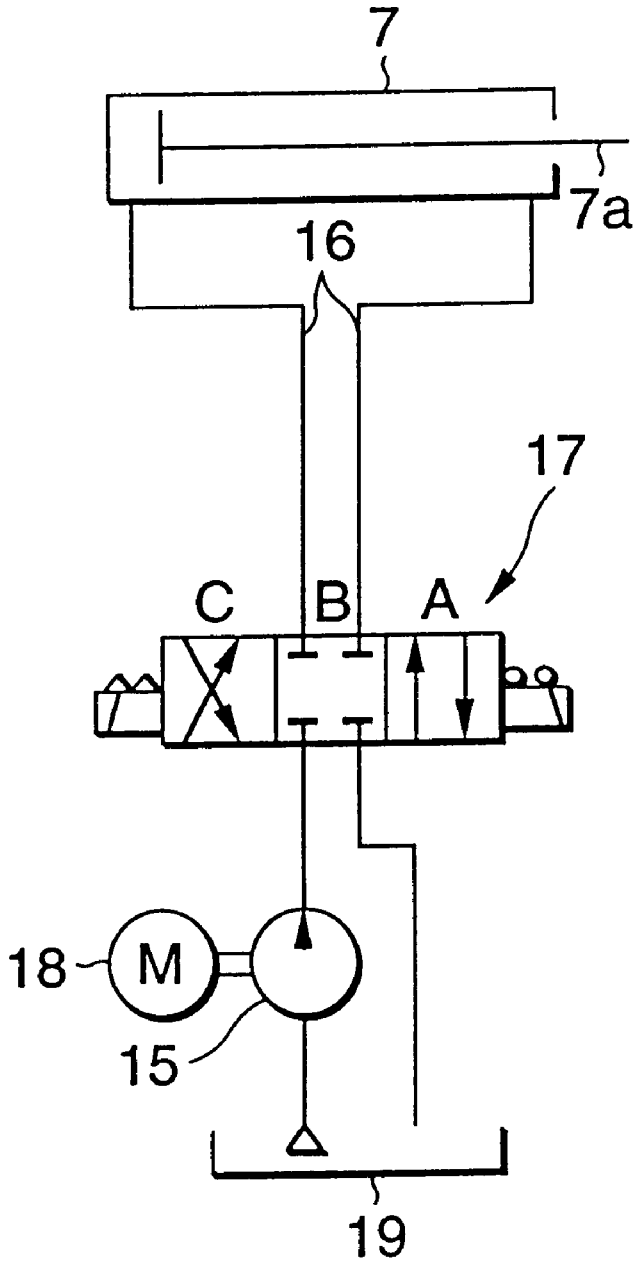
FIG.8 PRIOR ART
FIG. 8 is a circuit diagram of an oil pressure circuit employed in a conventional forklift.

In the above structure, if the lever main body 12*a* is moved from its neutral position (see a solid line shown in FIG. 2) toward its forward moving side c, then the connecting rod 12*b* is pushed out in the direction of an arrow line e shown in FIG. 2 to thereby switch the hand-operated switch valve 21 over to its right side expansion position A, and thus the piston rod 7*a* of the pusher cylinder 7 is expanded, so that the pusher 6 is moved forward, that is, in the arrow line a direction (see FIG. 6). Also, if the lever main body 12*a* is moved from the neutral position toward its backward moving side d, then the connecting rod 12*b* is pulled in the direction of an arrow line f shown in FIG. 2 to switch the hand-operated switch valve 21 over to its left side compression position C, and thus the piston rod 7*a* of the pusher cylinder 7 is compressed, so that the pusher 6 is moved backward in the arrow line b direction (see FIG. 6). Also, in a synchronous mode which will be discussed later, the lever main body 12*a* is moved toward the forward moving side c to thereby switch the pusher cylinder 7 over to the right side expansion position A, so that the hand-operated switch valve 21 can be opened fully.

The valve full-open switch 22, as shown in FIGS. 2 and 3, comprises a micro switch which is so disposed as to be opposed to a projection portion 25 provided on and projected from the connecting rod 12*b*. In operation, if the lever main body 12*a* of the pusher lever 12 is moved toward the forward moving side c to thereby push out the connecting rod 12*b* in the arrow e direction, then the projection portion 25 is contacted with a detector roller 22*a* provided on the valve full-open switch 22, thereby allowing the valve full-open switch 22 to detect that the hand-operated switch valve 21 is held in the fill-open state.

In FIG. 2, reference character 26 designates a pusher lever neutral position detector which comprises a micro switch and includes a detector roller 26*a* in contact with the outer peripheral edge portion of the connecting plate 23. In operation, when the pusher lever 12 is held in the neutral position (see the solid line shown in FIG. 2), a recessed portion 23*a* formed in the outer peripheral edge portion of the connecting plate 23 is engaged with the detector roller 26*a,* so that the pusher lever neutral position detector 26 detects that the pusher lever 12 is held at the neutral position.

Figure 4:
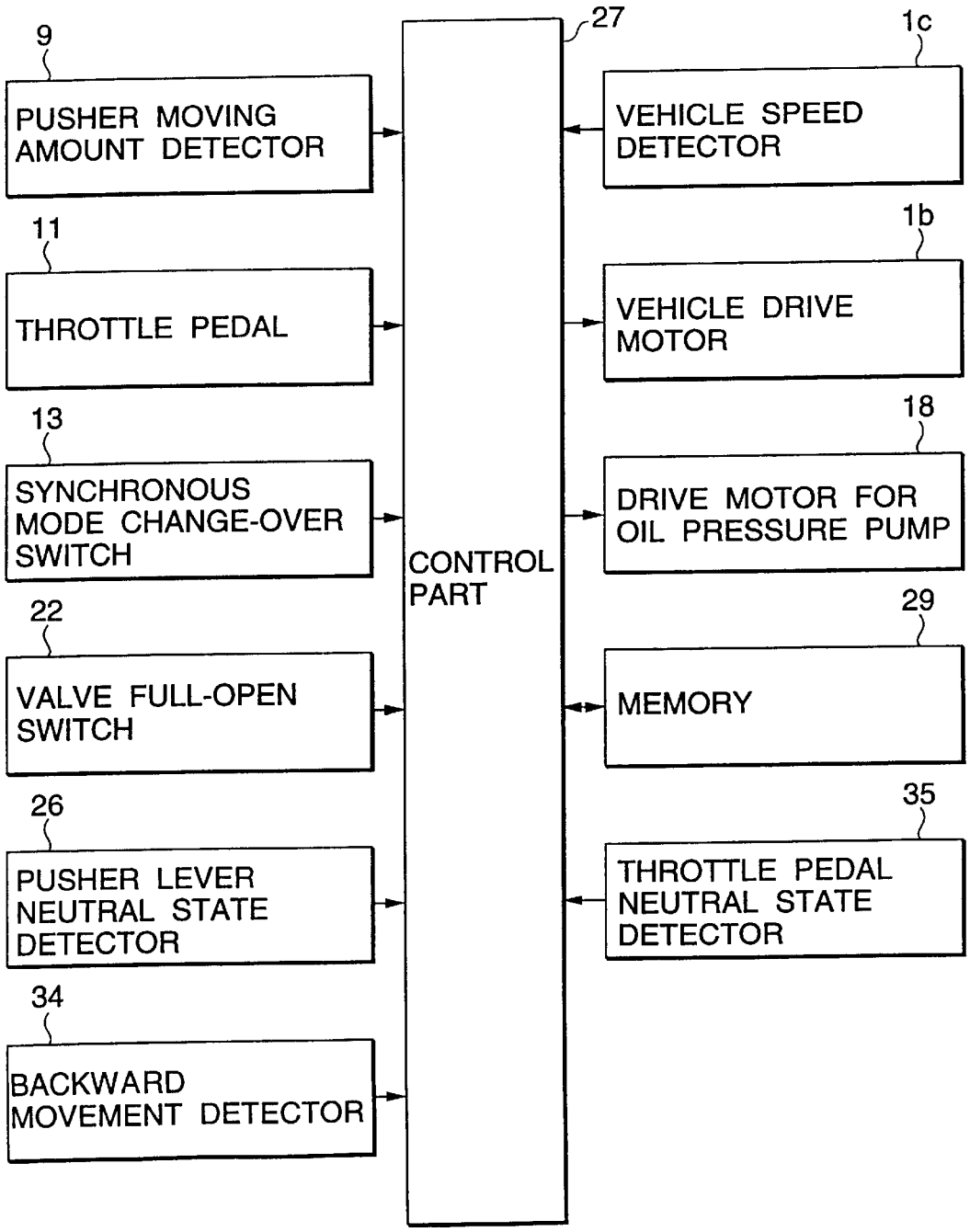
FIG. 4 is a block diagram of a control part employed in the embodiment, showing a control operation thereof.

Now, FIG. 4 is a block diagram to show the control operation of a control part 27 which is disposed within the vehicle body 1 and comprises a microcomputer. In accordance with signals respectively input from the above-mentioned pusher moving amount detector 9, throttle pedal 11, synchronous mode change-over switch 13, valve full-open switch 22, pusher lever neutral state detector 26, vehicle speed detector 1*c,* backward movement detector 34 for detecting the backward movement of the forward/backward moving lever 14, and throttle pedal neutral state detector 35 for detecting the neutral state of the throttle pedal 11, the control part 27 controls the vehicle body drive motor 1*b* and oil pressure drive motor 18 according to a program stored in a memory 29.

Figure 5:
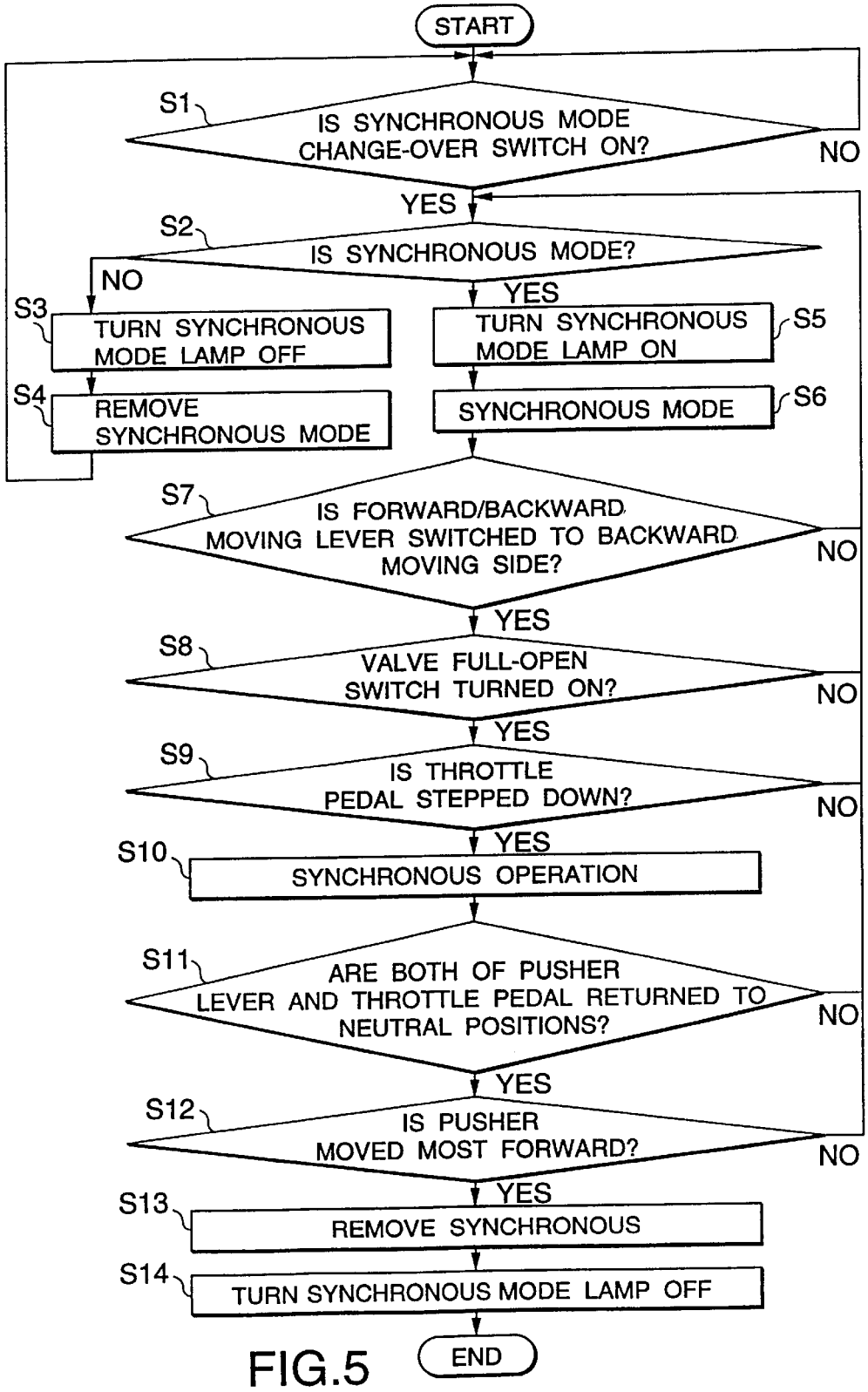
FIG. 5 is a flow chart of the control operation of the control part.

Now, description will be given below of the control operation of the control part 27 with reference to FIG. 5. That is, if the synchronous mode change-over switch 13 is depressed into the ON state (S1) while the baggage W is carried on the fork 4 (see a solid line shown in FIG. 6), then it is checked whether the synchronous mode change-over switch 13 is switched over to the synchronous mode or not (S2). If it is found that the synchronous mode change-over switch 13 is not switched over to the synchronous mode, then the synchronous mode lamp 13*a* is turned into its OFF state (S3), the synchronous mode is removed (S4), and the processing goes back to Step S1.

Figure 9:
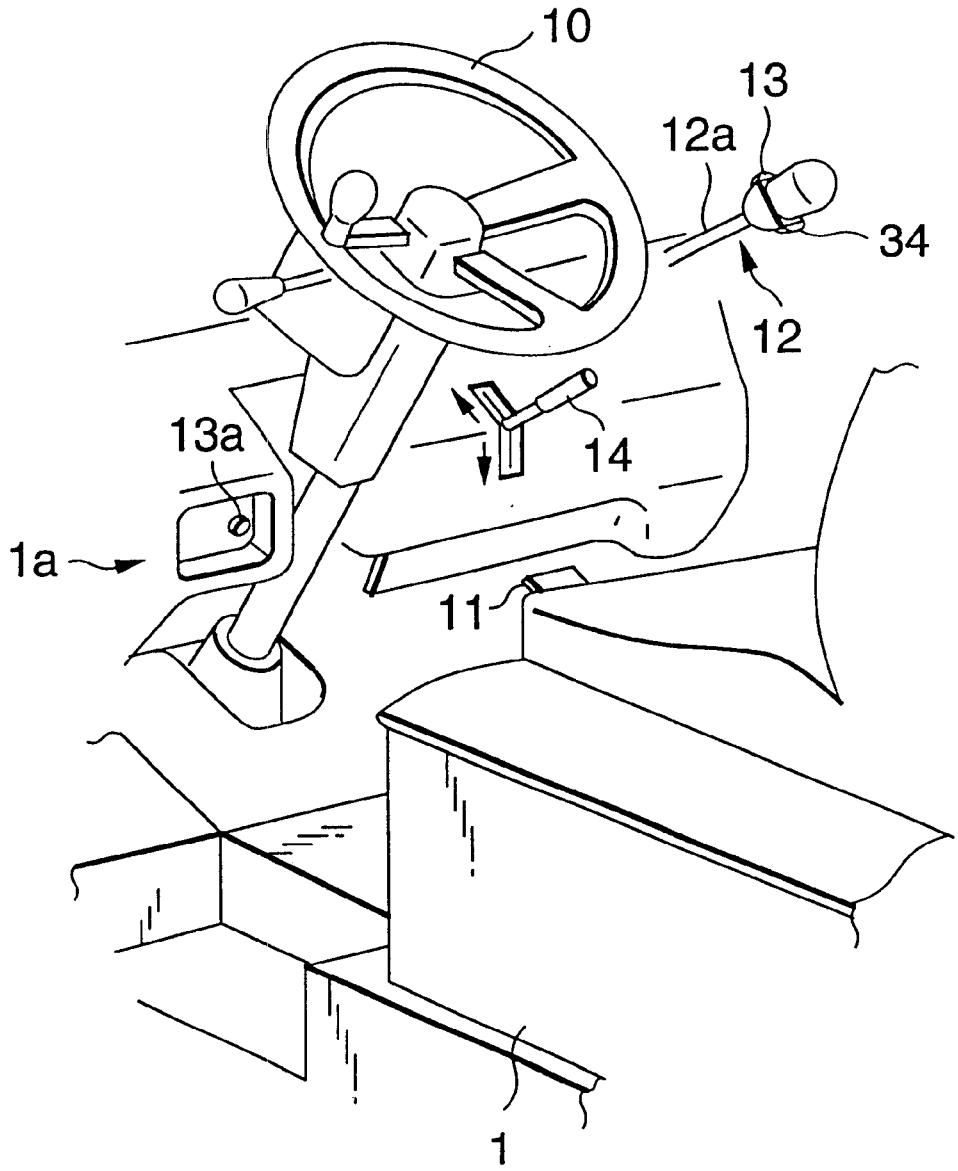
FIG. 9 is a perspective view of the main portions of a forklift according to an embodiment of the invention.
Figure 10:
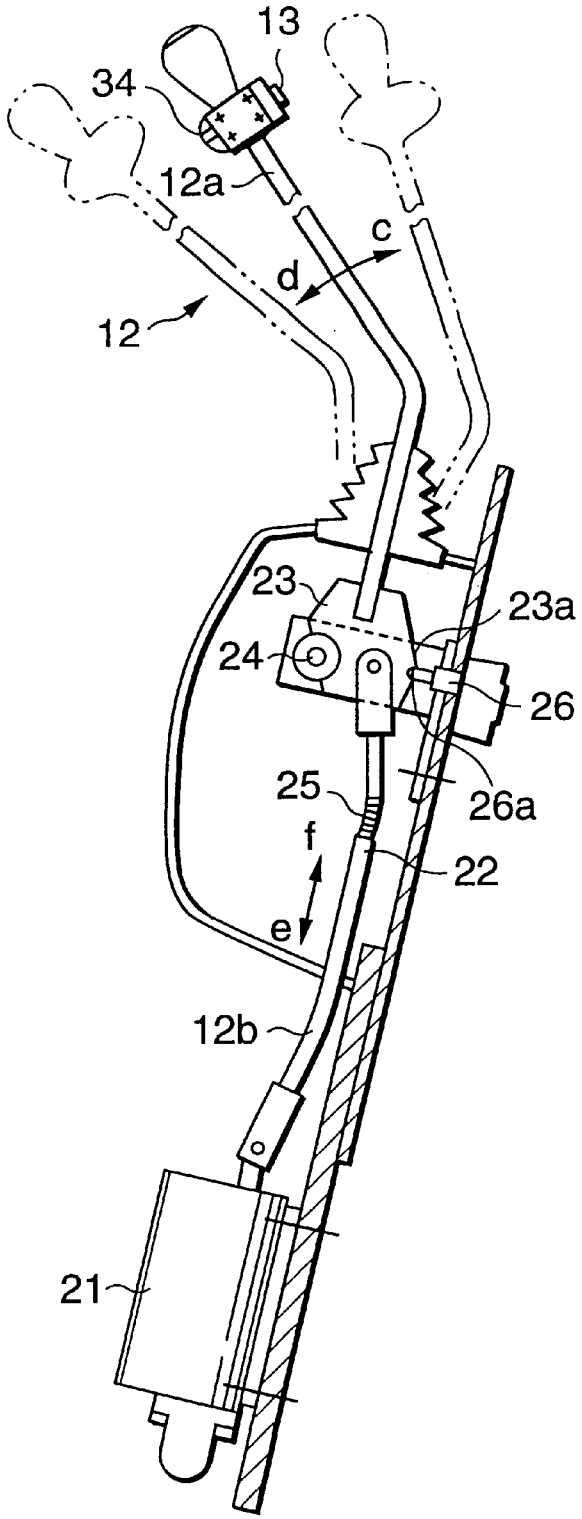
FIG. 10 is a lateral view of the pusher lever and its neighboring portion in the forklift of the present invention.

In FIGS. 9 and 10, the synchronous mode change-over switch is mounted on the upper end portion of the lever main body 12*a* of the pusher lever 12 by a mounting metal member 34, whereby an operator is able to press down the synchronous mode change-over switch 13 to thereby set up a synchronous mode without releasing his or her hand from the lever main body 12*a*.

In Step S2, if it is found that the synchronous mode change-over switch 13 is switched over to the synchronous mode, then the synchronous mode lamp 13*a* is turned into its ON state (S5), and the synchronous mode is set up or initiated (S6). Next, it is checked whether the forward/backward moving lever 14 is switched over to the backward moving side or not (S7). If a detect signal is input from the backward movement detector 34, then it is judged that the forward/backward moving lever 14 is switched over to the backward moving side, and the pusher lever 12 is moved toward the forward moving side. And, if the valve full-open switch 22 is held in the ON state, then it is judged that the hand-operated switch valve 21 is fully opened while it is switched over to the right side expansion position A (S8). Thus, if the throttle pedal 11 is stepped down to thereby switch the same into the ON state (S9), then the synchronous mode is operated (S10). In the synchronous mode, in synchronization with the time when the vehicle body drive motor 1*b* is driven to thereby move the vehicle body 1 backward, the oil pressure pump drive motor 18 is controlled to thereby adjust the pressure oil supply amount according to the step-down amount of the throttle pedal 11, whereby the expansion speed of the piston rod 7*a* is controlled and the pusher 6 is moved forward, that is, in the arrow line a direction (see FIG. 6) in synchronization with the backward movement c of the vehicle body 1, thereby pushing out the baggage W on the fork 4 (see imaginary line shown in FIG. 6) therefrom.

Next, the pusher lever 12 is switched over to the neutral position and, at the same time, the step-down state of the throttle pedal 11 is removed; and, it is checked whether the pusher lever 12 and throttle pedal 11 are both returned to their respective neutral states or not (S11). If there are input detect signals from the pusher lever neutral state detector 26 and throttle pedal neutral state detector 35, then it is judged that the pusher lever 12 and throttle pedal 11 have been both returned to their respective neutral positions, and also that the hand-operated switch valve 21 has been also returned to the neutral position. After then, the moving amount of the pusher lever 12 is detected by the pusher moving amount detector 9 and, in accordance with the detect signal of the pusher moving amount detector 9, it is checked whether the pusher 6 is moved most forward by a full stroke or not (S12). If it is found that the pusher 6 is moved most forward, then the synchronous mode is removed automatically (S13) and the synchronous mode lamp 13 is switched over to the OFF state (S14).

By the way, in Steps S7–S9, S11, and S12, if "NO" is judged, then the processing goes back to Step S2.

According to the above-mentioned structure, since the synchronous mode is removed automatically, there is eliminated the need that, as in the conventional forklift, an operator presses down the synchronous mode change-over switch 13 to thereby remove the synchronous mode. Due to this, the present structure does not take time and labor but can provide a high operation efficiency.

Now, description will be given below of another embodiment of a forklift according to the invention with reference to the accompanying drawings. In the present embodiment, in controls 1*a,* there is disposed an output adjusting device 32; in an oil pressure circuit 16 which connects together a pusher cylinder 7 and an oil pressure pump 15, there is disposed a hand-operated switch valve 21; and, a valve full-open switch 22 is disposed in such a manner that it is opposed to a pusher lever 12 which is used to operate the hand-operated switch valve 21 by hand. In FIG. 1, reference character 18 designates an oil pressure pump drive motor, while 19 stands for an oil pressure tank. The other remaining portions of the present embodiment than the above-mentioned portions thereof are substantially the same in structure as those employed in the conventional forklift shown in FIGS. 6 and 7. Therefore, they are given the same designations and thus the description thereof is omitted here.

Figure 11:
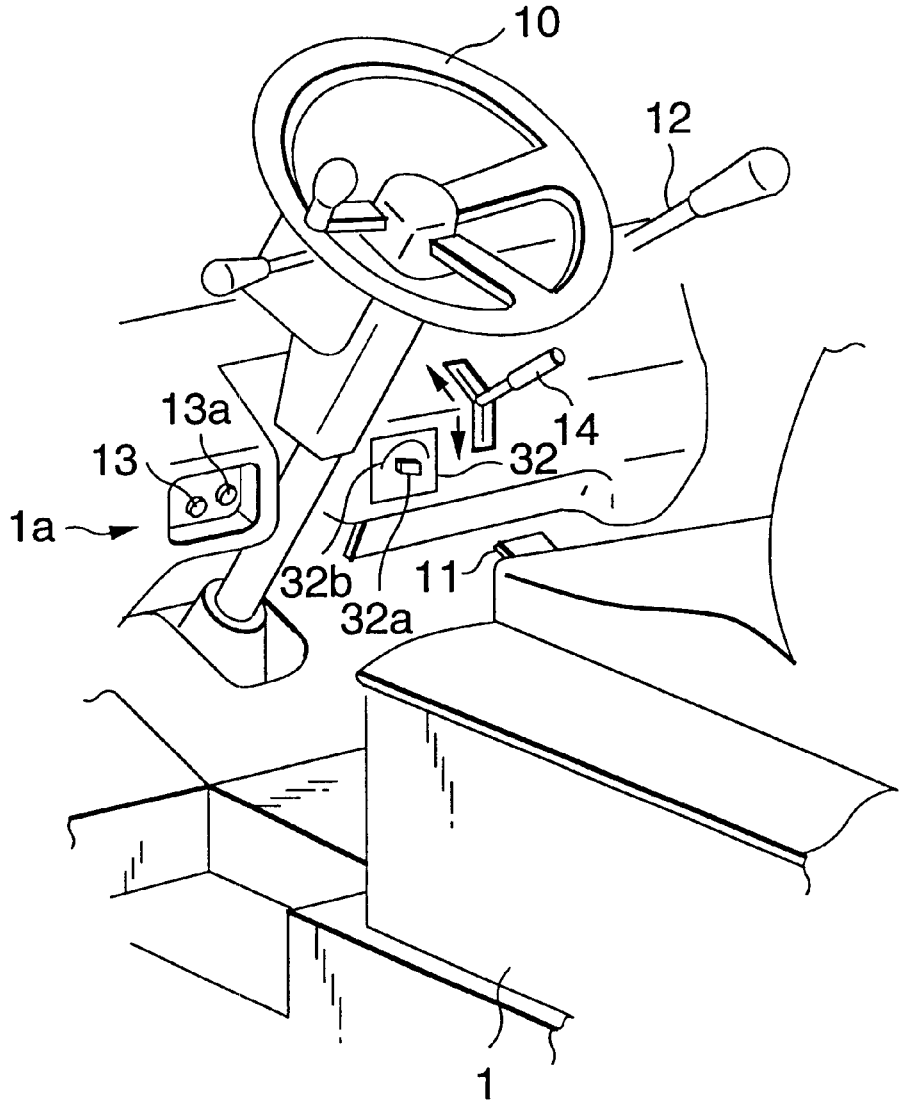
FIG. 11 is a perspective view of controls employed in a forklift according to an embodiment of the invention.

The output adjusting device 32, as shown in FIG. 11, comprises a variable resistor; and, in operation, if a knob portion 32*a* of the variable resistor is rotated along a scale 32*b* of the variable resistor to thereby adjust the volume thereof, then the output of the oil pressure pump drive motor 18 can be adjusted.

Figure 12:
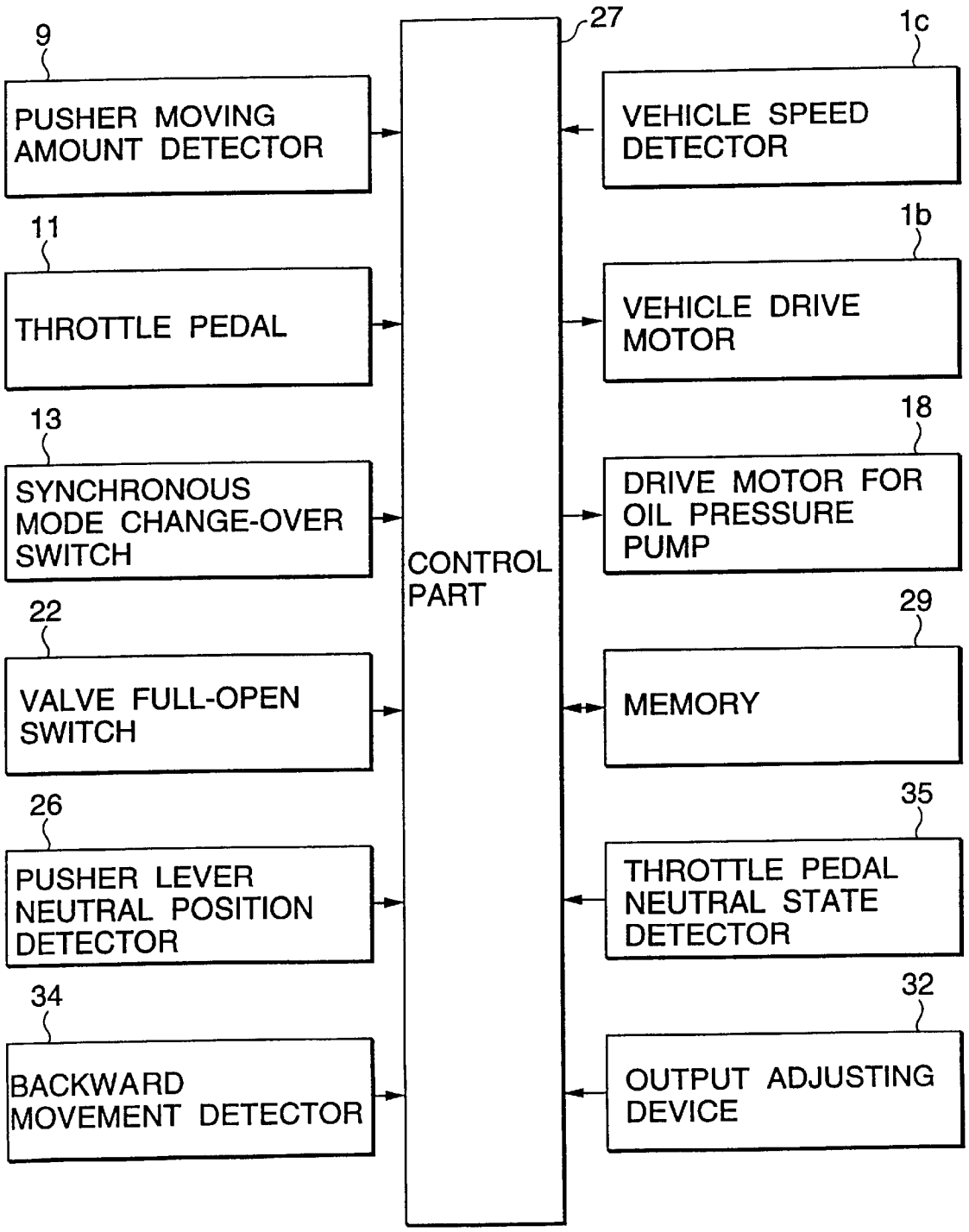
FIG. 12 is a block diagram of a control part of the present invention, which shows a control operation thereof.

Now, FIG. 12 shows the control operation of a control part 27 which comprises a microcomputer incorporated in the vehicle body 1 of the forklift. The control part 27 not only receives an output signal sent from the above-mentioned output adjusting device 32 but also, in accordance with input signals respectively sent from the pusher moving amount detector 9, throttle pedal 11, synchronous mode change-over switch 13, valve full-open switch 22, pusher lever neutral state detector 26, vehicle speed detector 1*c,* backward movement detector 34 for detecting the backward movement of the forward/backward moving lever 14, and throttle pedal neutral state detector 35 for detecting the neutral state of the throttle pedal 11, controls the vehicle body drive motor 1*b* and oil pressure pump drive motor 18 according to a program stored in a memory 29.

In the above-mentioned synchronous mode, when an operator judges from his or her visual observation that the backward movement b of the vehicle body 1 and the forward movement a of the pusher 6 do not synchronize with each other, for example, because the tire 1*d* of the vehicle body 1 is worn due to use for a long period of time, the operator may turn the knob portion 32*a* of the output adjusting device 32 to thereby adjust the volume thereof. In response to this, the control part 27 controls the output of the oil pressure pump drive motor 18 in accordance with the output signal of the output adjusting device 32 to thereby adjust the forward moving speed of the pusher 6, so that the synchronous error can be corrected.

In the above-mentioned embodiment, the output of the oil pressure pump drive motor 18 is adjusted by the output adjusting device 32. However, this is not limitative but, for example, there can also be employed a structure in which the output of the vehicle body drive motor 1*b* is adjusted by the output adjusting device 32.

According to the invention, in the oil pressure circuit which connects the oil pressure pump with the pusher cylinder for moving the pusher forward in synchronization with the backward movement of the vehicle body, there is disposed the inexpensive hand-operated switch valve, which can reduce the manufacturing cost of the forklift. Also, since the synchronous mode is operated when a detect signal is received from the valve full-open switch which detects that the hand-operated switch valve is fully opened, there is prevented the possibility that, as in the conventional forklift, the pressure oil supply amount to the pusher cylinder can be reduced excessively to thereby cause a poor synchronous operation, so that the synchronous operation can be carried out positively and thus the baggage on the forklift can be unloaded safely therefrom.

Also, according to the invention, the fully-opened state of the hand-operated switch valve can be confirmed by a simple structure which is composed of the projection portion provided on and projected from the pusher lever and the micro switch so disposed as to be opposed to the present projection portion, which makes it possible to reduce the manufacturing cost of the forklift.

According to the invention, because the synchronous mode change-over switch is mounted on the pusher lever, the operator is able to press down the synchronous mode change-over switch to thereby set up the synchronous mode without releasing his or her hand from the lever main body.

Also, according to the invention, after completion of the operation in the synchronous mode, the synchronous mode is automatically removed by the control part in accordance with not only the detect signal notifying that the pusher lever and throttle pedal have been returned to their respective neutral positions, but also the detect signal notifying that the pusher has moved most forward. Thanks to this, there is eliminated the need that, as in the conventional forklift, an operator presses down the synchronous mode change-over switch to thereby remove the synchronous mode, which does not take time and labor but can provide a high operation efficiency.

According to the invention, when there is produced an error between the actual vehicle speed and the detected vehicle speed, for example, because the tire of the vehicle body is worn due to use for a long period of time, the thus produced error can be corrected by adjusting the output of the oil pressure pump drive motor or vehicle body drive motor due to the operation of the output adjusting device, thereby allowing the backward movement of the vehicle body and the forward movement of the pusher to synchronize with each other with no error between them. Thanks to this, the pieces of baggage respectively pushed out from the fork by the pusher can be placed positively at their given positions without being rearranged in a state of disorder.

Also, according to the invention, because an inexpensive variable resistor is used, the manufacturing cost of the forklift can be reduced when compared with the conventional forklift. Also, in accordance with the output signal of the present variable resistor, the output of the oil pressure pump drive motor or vehicle body drive motor can be controlled accurately by the control part which comprises a microcomputer.

What is claimed is:

1. A forklift comprising:

a wheeled body supporting a pusher;

a pusher cylinder adapted to move said pusher relative to said wheeled body;

an oil pressure pump provided on said wheeled body;

an oil pressure circuit connected to said pusher cylinder and said oil pressure pump;

a hand-operated switch valve provided in said oil pressure circuit;

a valve full-open switch adapted to detect a filly open position of said hand-operated switch valve, and adapted to output a detect signal when the fully open position is detected; and control means for operating a synchronous mode in which said pusher cylinder moves said pusher forward in synchronization with a backward movement of said wheeled body only after first receiving the detect signal from said valve full-open switch.

2. The forklift as claimed in claim 1, further comprising:

a pusher lever for switching the state of said hand-operated switch valve; and a projection portion projected from said pusher lever, wherein said valve fill-open switch comprises a micro switch, wherein, when said pusher lever moves said hand-operated switch valve to the fully open position, said projection portion contacts with said micro switch, which then outputs the detect signal.

* * * * *